US006785913B2

(12) United States Patent
Ho

(10) Patent No.: US 6,785,913 B2
(45) Date of Patent: Sep. 7, 2004

(54) FLUSHING MECHANISM FOR A DUAL FLUSH CISTERN

(75) Inventor: King Chee Ho, Selangor (MY)

(73) Assignee: Cistern Technology Pte., Ltd., Singapore (SG)

( * ) Notice: Subject to any disclaimer, the term of this patent is extended or adjusted under 35 U.S.C. 154(b) by 0 days.

(21) Appl. No.: 10/181,764

(22) PCT Filed: Jan. 12, 2001

(86) PCT No.: PCT/IB01/00021

§ 371 (c)(1),
(2), (4) Date: Oct. 9, 2002

(87) PCT Pub. No.: WO01/53616

PCT Pub. Date: Jul. 26, 2001

(65) Prior Publication Data

US 2003/0131403 A1 Jul. 17, 2003

(30) Foreign Application Priority Data

Jan. 20, 2000 (MY) ..... 20000193

(51) Int. Cl.[7] ..... E03D 1/14
(52) U.S. Cl. ..... 4/325; 4/391; 4/410
(58) Field of Search ..... 4/324, 325, 390, 4/391, 410

(56) References Cited

U.S. PATENT DOCUMENTS 413,590 A * 10/1889 White ..... 4/391
1,808,329 A * 6/1931 Tilden ..... 4/391
5,331,690 A * 7/1994 Pourcier ..... 4/410
6,442,772 B2 * 9/2002 Han et al. ..... 4/325

FOREIGN PATENT DOCUMENTS

CH 169290 * 5/1934 ..... 4/325

* cited by examiner

*Primary Examiner*—Robert M. Fetsuga
(74) *Attorney, Agent, or Firm*—Lowe Hauptman Gilman & Berner LLP

(57) ABSTRACT

A flushing mechanism for a dual flush cistern system comprises a float assembly (1) comprising a hollow valve stemn (2) carrying a sealing valve (3) for sealing the outlet opening of the cistern at or towards one end and being open at each end to define an overflow passage and a float (6) fixedly attached around the valve stem (2), a cylindrical guide member (7) surrounding the float (6) and having at the end adjacent the sealing valve at least one opening to allow liquid to pass to the outlet opening, an operating rod (17) arranged to move vertically upward to raise the float assembly (1) to open the vavle (3), first and second operating means (25, 26) arranged to effect such vertical movement of the operating rod (17), the first operating means (25), an operation, being arranged to raise the float assembly (1) a first distance to a level which the float assembly (1) is buoyant, and the second operating means (26) being arranged to raise the float assembly (1) a second distance, less than the first distance in a level at which the float assembly (1) is not buoyant, whereby when the first operating means (25) is operated and released, a first predetermined quantity of liquid flows from the cistern, and when the second operating means (26) is operated and released a second, smaller, predetermined quantity of liquid flows from the cistern.

13 Claims, 3 Drawing Sheets

FLUSHING MECHANISM FOR A DUAL FLUSH CISTERN

BACKGROUND TO THE INVENTION

In recent years it has, in many countries, been a requirement that all new toilet cisterns installed should have a dual-flush function, in which a full flush releasing a large quantity of flushing liquid can be used when solid waste is to disposed of and a partial flush releasing a smaller quantity of flushing liquid can be used when a full flush is not required, for example, when liquid waste is to be disposed of.

Many such mechanisms for dual flush cisterns have been proposed.

In certain systems the cistern is divided into two parts by a weir having a movable gate such that when a partial flush is required the gate remains closed and only the liquid on one side of the weir is released through the cistern outlet but when a full flush is required the gate is opened allowing liquid on both sides of the weir to pass through the outlet. Examples of such dual flush mechanisms are disclosed in AU-B-56165/80 and WO93/15284.

Another type of dual flushing mechanism relies on closing the outlet valve after different times depending on whether a full or partial flush is required.

Examples of such mechanism are described, for example, in AU-A-28538/84, AU-B-80111/87, AU-B-40396/85 and WO93/15284.

The prior art mechanisms generally include a float assembly comprising a float associated with the valve stem of the outlet closure valve and either attached to or slideable on the valve stem. The float reduces the negative buoyancy of the float assembly so that the float assembly sinks at a slower rate to close the valve than it would do if the float were not present.

The majority of the prior art mechanisms include a large number of moving parts and are complicated in their structure in that various non-linear motions are involved in operation of the valve.

It is the object of this invention to provide a flushing mechanism for a dual flush cistern that is very much simpler than the existing mechanisms.

SUMMARY OF THE INVENTION

This invention provides a dual flush system comprising a float assembly comprising a hollow valve stem carrying a sealing valve for sealing the outlet opening of the cistern at or towards one end and being open at each end to define an overflow passage and a float fixedly attached around the valve stem, a cylindrical guide member surrounding the float and having at the end adjacent the sealing valve at least one opening to allow liquid to pass to the outlet opening, an operating rod arranged to move vertically upward to raise the float assembly to open the valve, first and second operating means arranged to effect such vertical movement of the operating rod, the first operating means, on operation, being arranged to raise the float assembly a first distance, and the second operating means being arranged to raise the float assembly a second distance less than the first distance, whereby when the first operating means is operated and released, a first predetermined quantity of liquid flows from the cistern, and when the second operating means is operated and released a second, smaller, predetermined quantity of liquid flow from the cistern.

The float preferably comprises an inverted cup-shaped member which traps air, thereby reducing the negative buoyancy of the float assembly. The rate of closing the valve is dependent on the hydrostatic pressure acting on the float and on the distance that the float has to move to close the valve. Thus, the float assembly is designed so that when the float assembly is raised by the first, full flushing, distance the float is buoyant and so falls to close the valve as the level of the liquid supporting it drops thereby allowing the predetermined quantity of liquid to flow from the cistern. However, when it is raised by the second, partial flushing, distance the hydrostatic pressure on the float surface is such that the float is not buoyant and the valve starts to close as soon as the operating means is released the rate of closure being such that the second predetermined amount of liquid flows from the cistern.

In some instances for example when the operating means is held down for too long a time or is operated too violently the water level in the cistern may drop so far or the float assembly may gain sufficient momentum to move further upward than the second predetermined distance that the assembly may become buoyant. Preferably, therefore, the second operating means, on operation, in addition to raising the float assembly also operates a stop mechanism acting on some part of the float assembly to prevent movement of the float assembly greater than the second distance in its simplest form, such stop mechanism comprises a rod which on operation of the second operating means, is introduced into the float guide member to a predetermined level to contact the upper surface of the float when the float has reached the desired height. Preferably, the stop mechanism is adjustable to allow fine-tuning of the quantity of liquid that flows from the cistern in a partial flush. This may be achieved by means of a screw thread on the road by means of which the lower end of the rod can be raised or lowered relative to the float. The rod preferably passes through a guide member mounted on the rim of the float guide member in order to constrain movement of the rod only to an up and down movement.

The operating means preferably comprises a pair of push buttons on the top of the tank, depression of which moves a pivoted fever which is connected to the operating rod. However, especially when the mechanism is intended for use as a conversion kit for an existing lever operated cistern the operating means may comprise a pair of levers, for example mounted on concentric shafts with appropriate linkages to the operating rod.

The operating mechanism is preferably carried on a bracket which is mounted on the side of the float guide means, the length of which is preferably adjustable to allow the mechanism to be used in cisterns of different height. In a mechanism in which the length of the bracket is adjustable the length of the operating rod end of the stop rod, when present must also be adjustable.

Preferably the second operating means, on operation, in addition to raising the float assembly, also operates a stop mechanism acting on some part of the float to prevent movement of the float a distance greater than the second distance. The stop mechanism is preferably a rod which on operation of the second operating means is introduced into the float guide member to contact the upper surface of the float when the float has reached its desired height.

In a preferred form of the operating mechanism, the connection between the operating means and the float assembly, comprises a rod or bar with a plurality of spaced holes at least at its end adjacent to the float assembly which cooperates with a bracket on the float guide member which also has at least one hole through which a fixing pin can be passed into one of the holes on the bracket. The operating rod and the stop rod may be telescopic and maybe held together by locating pins which can pass through locating holes, as necessary. In the case of the stop rod, the rod is preferably mounted in a U-shaped rod carrier and the locating pins are permanently attached to the rod sot that the rod can be rotated to snap the pin into and out of one of a plurality of notches on the rod carrier. The rod carrier may be mounted by a screw thread on the second operating means to allow fine adjustment of the effective length of the rod.

DESCRIPTION OF PREFERRED EMBODIMENT

The invention will now be described in greater detail by way of example with reference to the drawings, in which.

Figure 1:
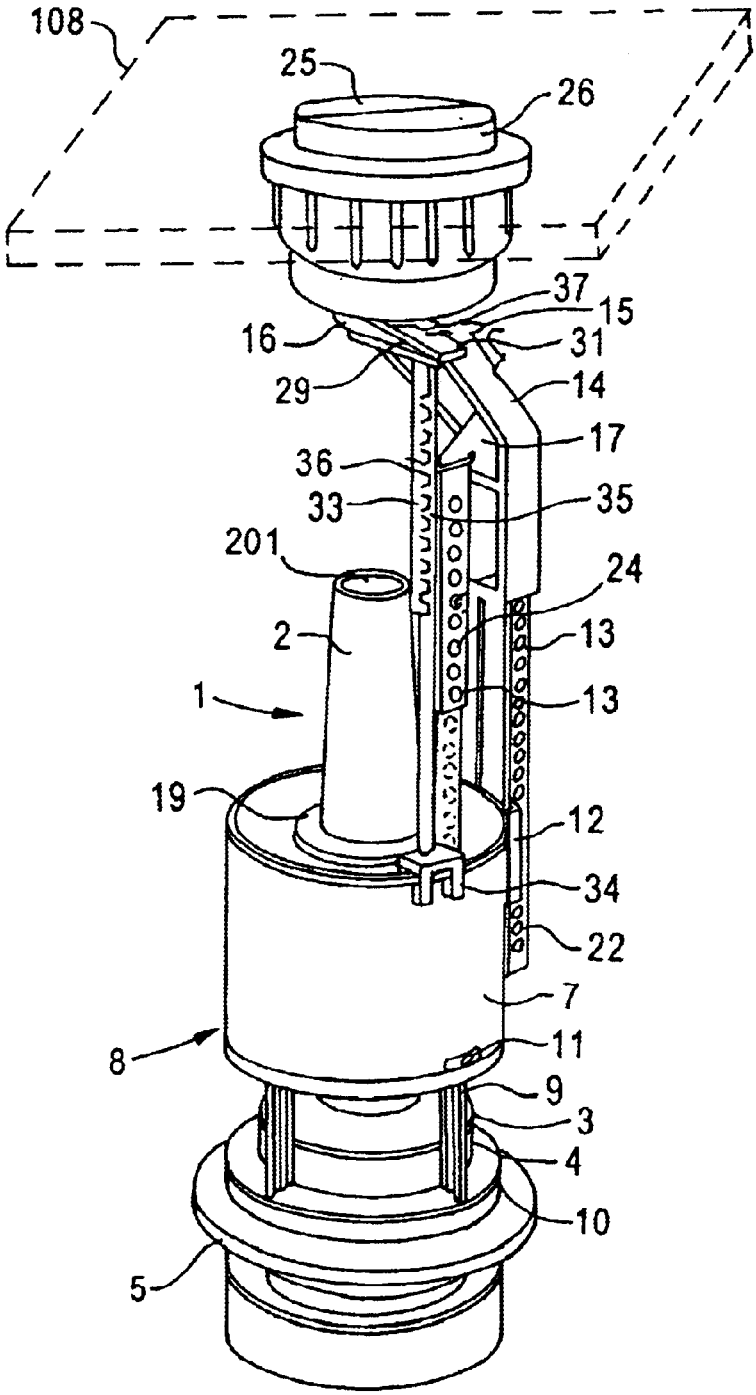
FIG. 1 is an isometric view of one form of flushing mechanism according to the invention in the closed position of the valve.
Figure 2:
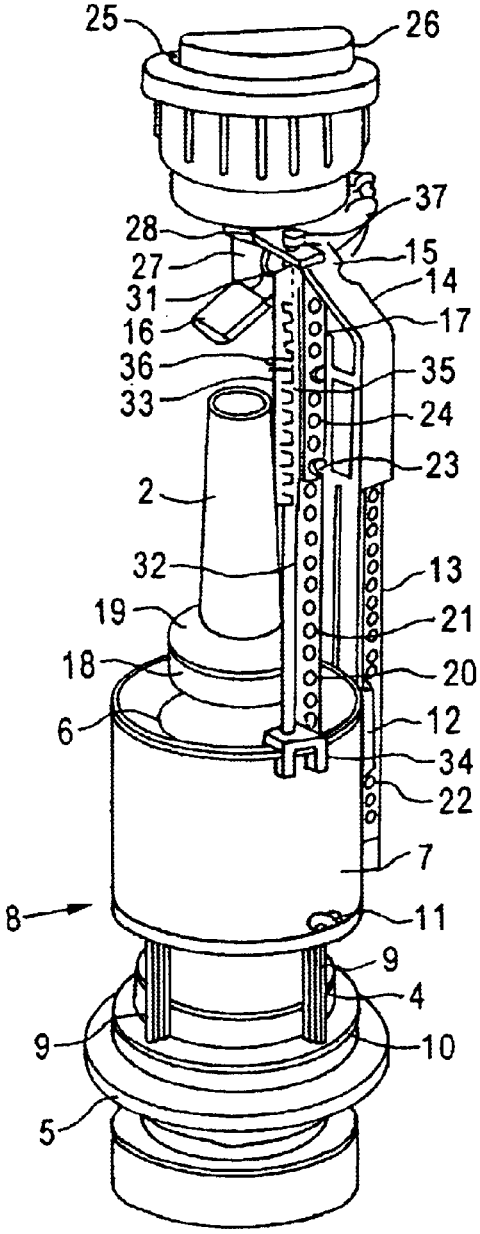
FIG. 2 is an isometric view of the valve mechanism of FIG. 1 in the full flush position.

As shown in the drawings, the flushing mechanism comprises a float assembly indicated generally by reference numeral 1 which comprises a valve stem 2 which is hollow and open at both ends (only one of which is visible at 201 in FIG. 1) and carries towards one end a valve closure member 3 which seats on a valve seat 4 on a fixture member 5 by which the float assembly 1 is mounted to the outlet (not shown) of a toilet system (also not shown). Float assembly 1 also includes a float 6 in the form of an inverted cup member which is fixedly attached around valve stem 2. Float 6 is closely surrounded by a cylindrical portion 7 of a float guide 8. Cylindrical portion 7 is spaced from the bottom of the cistern and the valve seat by means of legs 9 on a spacer member 10 which is attached to cylindrical portion 7 by a bayonet fixing 11 at one end and at the other end is attached to fixture member 5. The base of cylindrical portion 7 is closed to limit the maximum movement of float assembly 1. Valve stem 2 defines an overflow passage 202 best seen in FIG. 4.

On its outer surface, cylindrical portion 7 carries a bracket 12 for mounting a support arm 13 for the flush operating mechanism. The support arm 13 is cranked at its upper end 14 and terminates in a yoke 15 supporting a pivotally mounted operating lever 16. One end of lever 16 is attached to a cranked operating rod 17 which extends into cylindrical portion 7 the portion within cylindrical portion 7 being attached to valve stem 2 by means of a collar 18 which abuts against the underside of a flange 19 on valve stem 2. Collar 18 is attached to operating rod 17 by means of a pin 20 which passes into one of a number of holes 21 in operating rod 17. Downward pressure on the end of lever 16 remote from the connection of operating rod 17 causes operating rod 17 to move upwardly carrying the float assembly 1 with it and thereby causing the valve 3, 4 to open to allow liquid to exit the cistern.

Support arm 13 is connected to bracket 12 by means of locking pins (not shown) engaging in one or more of holes 22 in supporting arm 13 so that the distance between the operating mechanism and the float assembly 1 can be varied to suit cisterns of different height. Operating rod 17 is formed in two parts, connected by means of pins 23 locating in holes 24 in the two parts of the operating rod 17 thereby allowing length adjustment of operating rod 17.

The operating mechanism includes first and second operating means or members, i.e., two push buttons 25, 26 which are arranged on the top 108 of the cistern and serve to depress the end of lever 16 remote from the connection of operating rod 17.

The push buttons 25, 26, are spring loaded sot that they are biased to an inoperative position.

Each of push buttons 25, 26 has a projection 27, 28 on its lower surface which, when a button 25, 26 is pressed acts on lever 16 to move operating rod 17 upwardly. Projection 27 on the full flush button 26 is longer than the projection 28 on partial flush button 26, so that when push button 25 is pressed, the operating rod 17 is lifted by a greater distance and hence lifts the float assembly further away from the valve seat 6 then when push button 26 is pressed.

Figure 3:
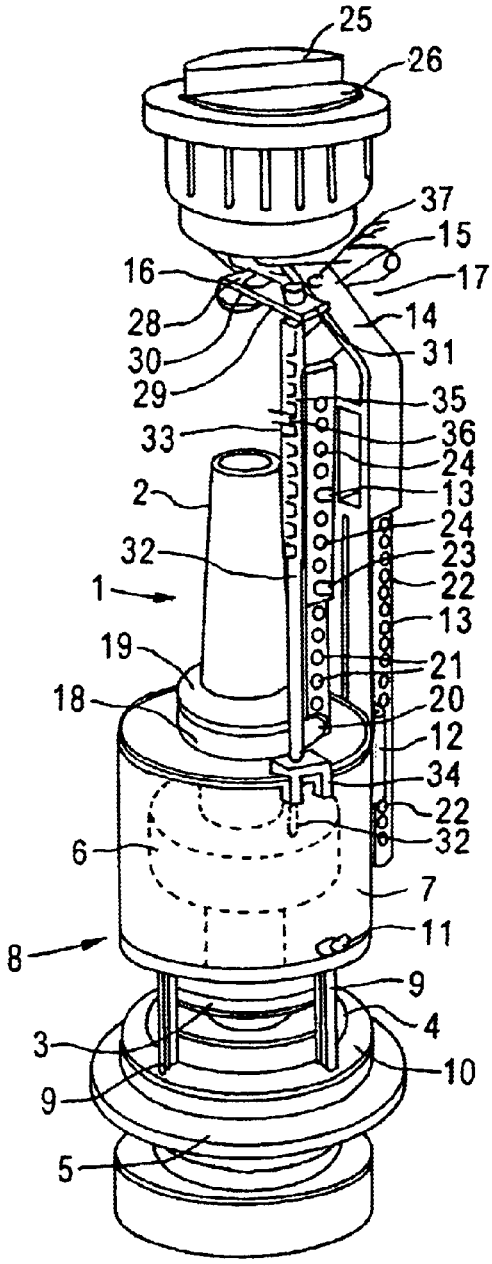
FIG. 3 is an isometric view of the mechanism of FIG. 1 in the partial flush position.

The projection 28 on push button 26 is connected to a further lever 29 which at one end 30 overlaps the operative end of lever 16 and at the other end 31 is attached to a stop rod 32 via a U-shaped rod carrier 33. Stop rod 32 and rod carrier 33 together define a stop mechanism. Stop rod 32 passes through a guide 34 on the rim of cylindrical portion 7. Depression of button 26 causes projection 28, in addition to causing operating rod 16 to move upwardly thereby raising the float assembly 1 also depresses stop rod 32 within cylindrical portion 7 to further limit the possible movement of float assembly 1 by causing the stop rod 32 to contact some part, i.e., the upper surface of the float 6, as shown by the phantom line in FIG. 3.

Rod carrier 33 is attached to lever 29 by means of a screw 37 which passes through a screw-threaded bore in end 31 of lever 29 to allow adjustment of the distance between rod carrier 33 and lever 29 thereby allowing fine tuning of the distance that rod 32 extends into cylindrical portion 7. In addition carrier member 33 has a plurality of notches 35 into which a pin 36 protruding from the surface of rod 32 can be snapped, to allow larger adjustment of the effective length of rod 32.

Figure 4:
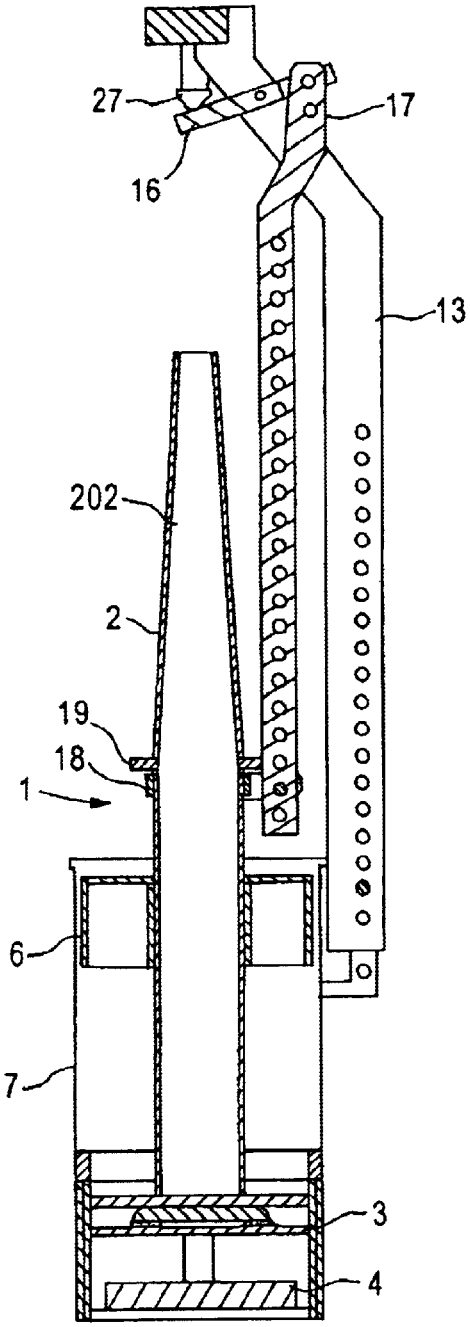
FIG. 4 is a section through the mechanism of FIG. 1 in the full flush position but with the stop rod not shown.

As shown in FIG. 4, in the full flush position, float assembly 1 is raised by means of operating rod 17 to a level such that the top of float 5 almost reaches the upper edge of cylindrical portion 7. At this level the air trapped under float 5 is sufficient to make float assembly 1 buoyant so that the float assembly 1 does not sink under its own weight when push button 25 is released but instead merely falls as the water level in the cistern drops.

Figure 5:
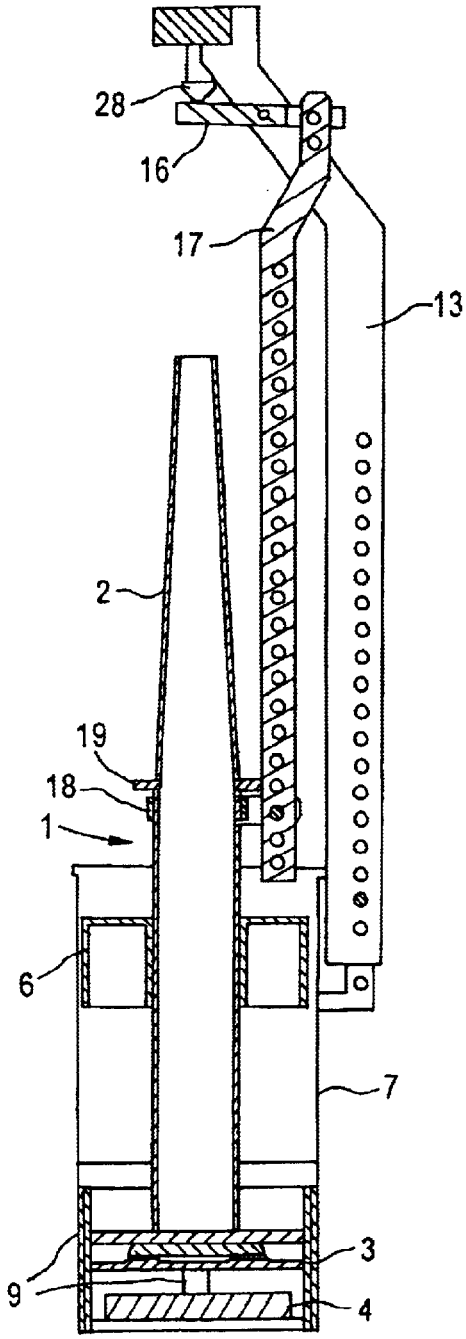
FIG. 5 is a view as in FIG. 4 in the partial flush position.

As shown in FIG. 5, in the partial flush portion, float assembly 1 is raised to a lesser level. At this lower level the hydrostatic pressure acting on float 6 is sufficient to overcome the buoyancy of float assembly 1 so that when push button 26 is released, the float assembly 1 will sink under its own weight albeit at a slower rate than it would if the float 6 were not present.

What is claimed is:

1. A flushing mechanism for a dual flush cistern system comprising a float assembly (1) comprising a hollow valve stem (2) carrying a sealing valve (3) for sealing the outlet opening of the cistern at or towards one end and being open at each end to define an overflow passage and a float (6) fixedly attached around the valve stem (2), a cylindrical guide member (7) surrounding the float (6) and having at the end adjacent the sealing valve at least one opening to allow liquid to pass to the outlet opening, an operating rod (17)

arranged to move vertically upward to raise the float assembly (1) to open the valve (3), first and second operating means (25, 26) arranged to effect such vertical movement of the operating rod (17), the first operating means (25) on operation, being arranged to raise the float assembly (1) a first distance to a level which the float assembly (1) is buoyant and the second operating means (26) being arranged to raise the float assembly (1) a second distance, less than the first distance to a level at which the float assembly (1) in not buoyant, whereby when the first operating means (25) is operated and released, a first predetermined quantity of liquid flows from the cistern, and when the second operating means (26) is operated and released a second, smaller, predetermined quantity of liquid flows from the cistern:

wherein the second operating means (25), on operation, in addition to raising the float assembly (1) also operates a stop mechanism (32, 33) acting on some part of the float assembly (1) to prevent movement of the float assembly (1) greater than the second distance; and wherein the stop mechanism (32, 33) comprises a rod (32) which, on operation of the second operating means (26), is introduced into the float guide member (7) to a predetermined level to contact the upper surface of the float (6) when the float (6) has reached the desired height.

2. A mechanism according to claim 1, wherein the stop mechanism (32, 33) is adjustable to allow fine-tuning of the quantity of liquid that flows from the cistern in a partial flush.

3. A mechanism according to claim 1, wherein the rod (32) passes through a guide member (34) mounted on the rim of the float guide member (7) to constrain movement of the road (32) only to an up and down movement.

4. A mechanism according to claim 1, further comprising a lever (16) which is connected to the operating rod (17) and adapted to be moved, and hence to move the operating rod (17), when the operating means (25, 26) are operated; wherein the lever (16) is supported by a support arm (13) which is carried on a bracket (12) which is mounted on a side of the guide member (7); and the lengths of the support arm (13), the operating rod (17) and the rod (32) of the stop mechanism are adjustable.

5. A flushing mechanism for a dual flush cistern system comprising a float assembly (1) comprising a hollow valve stem (2) carrying a sealing valve (3) for sealing the outlet opening of the cistern at or towards one end and being open at each end to define an overflow passage and a float (6) fixedly attached around the valve stem (2), a cylindrical guide member (7) surrounding the float (6) and having at the end adjacent the sealing valve at least one opening to allow liquid to pass to the outlet opening, an operating rod (17) arranged to move vertically upward to raise the float assembly (1) to open the valve (3), first and second operating means (25, 26) arranged to effect such vertical movement of the operating rod (17), the first operating means (25) on operation, being arranged to raise the float assembly (1) a first distance to a level which the float assembly (1) is buoyant and the second operating means (26) being arranged to raise the float assembly (1) a second distance, less than the first distance to a level at which the float assembly (1) in not buoyant, whereby when the first operating means (25) is operated and released, a first predetermined quantity of liquid flows from the cistern, and when the second operating means (26) is operated and released a second, smaller, predetermined quantity of liquid flows from the cistern;

wherein the operating means (25, 26) comprises a pair of push buttons on the top of the cistern, depression of which moves a pivoted lever (16) which is connected to the operating rod (17); and wherein the lever (16) is supported by a support arm (13) which is carried on a bracket (12) which is mounted on a side of the guide member (7), the length of the support arm (13) being adjustable to allow the mechanism to be used in cisterns of different height, the length of the operating rod (17) being also adjustable.

6. A flushing mechanism for a dual flush cistern, said flushing mechanism comprising:

a float assembly comprising a hollow valve stem and a float fixedly attached to said valve stem, said valve stem having upper and lower ends and being open at both said ends to define an overflow passage, said valve stem carrying a valve at the lower end for closing the outlet opening of the cistern;

a hollow float guide member surrounding the float and having at the end adjacent the sealing valve at least one opening to allow liquid in the cistern to pass to the outlet opening;

an operating rod arranged to move vertically upward to raise the float assembly to open the valve;

first and second operating members arranged to effect such vertical movement of the operating rod, wherein when the first operating member is operated the float assembly is raised to a first level and when the second operating member is operated the float assembly is raised to a second level lower than the first level, whereby when the first operating member is operated and released, a first predetermined quantity of liquid is flushed from the cistern, and when the second operating member is operated and released a second, smaller, predetermined quantity of liquid is flushed from the cistern; and a rod acting on the float assembly to prevent the float assembly from rising above the second level, said rod being arranged to be acted upon by said second operating member, when said operating member is operated, and to extend into the float guide member to contact the upper surface of the float and stop rising of said float when the float has reached the second level.

7. A mechanism according to claim 6, wherein the float comprises an inverted cup-shaped member which traps air, thereby reducing the negative buoyancy of the float assembly.

8. A mechanism according to claim 6, wherein the length of said rod is adjustable to allow fine-tuning of the quantity of liquid that is flushed from the cistern in a partial flush when said second operating member is operated.

9. A mechanism according to claim 6, wherein the operating members comprise a pair of push buttons arranged on the top of the cistern, said mechanism further comprising a pivoted lever which is connected to the operating rod at one end and adapted to be acted upon at the other end by said buttons when said buttons are depressed.

10. A mechanism according to claim 9, wherein the lever is pivotally supported by an upright support arm which is attached to the float guide member, and the length of the support arm is adjustable.

11. A mechanism according to claim 6, wherein the length of the operating rod is adjustable.

12. A flushing mechanism for a dual flush cistern, said flushing mechanism comprising:

a float assembly comprising a hollow valve stem and a float fixedly attached to said valve stem, said valve stem having upper and lower ends and being open at both said ends to define an overflow passage, said valve stem carrying a valve at the lower end for closing the outlet opening of the cistern;

a hollow float guide member surrounding the float and having at the end adjacent the sealing valve at least one opening to allow liquid in the cistern to pass to the outlet opening;

an operating rod arranged to move vertically upward to raise the float assembly to open the valve;

first and second operating members arranged to effect such vertical movement of the operating rod, wherein when the first operating member is operated the float assembly is raised to a first level and when the second operating member is operated the float assembly is raised to a second level lower than the first level, whereby when the first operating member is operated and released, a first predetermined quantity of liquid is flushed from the cistern, and when the second operating member is operated and released a second, smaller, predetermined quantity of liquid is flushed from the cistern;

an upright support arm which is attached to the float guide member and is adjustable in length; and a lever pivotally supported by said support arm, wherein said lever is connected to the operating rod at one end and adapted to be acted upon at the other end by said operating members when said operating members are operated.

13. A mechanism according to claim 12, wherein the length of the operating rod is adjustable.

* * * * *